US011235188B2

(12) United States Patent
Gilchrist

(10) Patent No.: US 11,235,188 B2
(45) Date of Patent: Feb. 1, 2022

(54) EXERCISE DEVICE AND METHOD OF EXERCISING USING SAID DEVICE

(71) Applicant: FITNESS ENGINEERS PTY LTD, Bondi Beach (AU)

(72) Inventor: Adam Gilchrist, Queenscliff (AU)

(73) Assignee: F45 TRAINING PTY LTD, Gordon (AU)

( * ) Notice: Subject to any disclaimer, the term of this patent is extended or adjusted under 35 U.S.C. 154(b) by 21 days.

(21) Appl. No.: 15/320,462

(22) PCT Filed: Jun. 19, 2015

(86) PCT No.: PCT/AU2015/000358
§ 371 (c)(1),
(2) Date: Dec. 20, 2016

(87) PCT Pub. No.: WO2015/192170
PCT Pub. Date: Dec. 23, 2015

(65) Prior Publication Data

US 2017/0136278 A1 May 18, 2017

(30) Foreign Application Priority Data

Jun. 20, 2014 (AU) ..... 2014100698

(51) Int. Cl.
*A63B 71/06* (2006.01)
*A63B 6/00* (2006.01)
(Continued)

(52) U.S. Cl.
CPC ..... *A63B 17/00* (2013.01); *A63B 4/00* (2013.01); *A63B 5/20* (2013.01); *A63B 6/00* (2013.01);
(Continued)

(58) Field of Classification Search
CPC ..... A63B 17/00; A63B 23/0458; A63B 4/00; A63B 21/0552; A63B 23/1218;
(Continued)

(56) References Cited

U.S. PATENT DOCUMENTS 3,561,757 A * 2/1971 Schillig ..... A63B 9/00 482/35
5,395,296 A * 3/1995 Webster ..... A63B 21/04 482/130
(Continued)

OTHER PUBLICATIONS

Weider, PRO 9640 User's Manual,ICON Health & Fitness, Inc., 1996, 1-34.*
(Continued)

*Primary Examiner* — Sundhara M Ganesan
*Assistant Examiner* — Shila Jalalzadeh Abyaneh
(74) *Attorney, Agent, or Firm* — E. Eric Mills; Todd A. Serbin; Nexsen Pruet, PLLC

(57) ABSTRACT

A mobile exercise device (1) having a plurality of exercise equipment modules (2, 3, 4). Each said module including a frame (7, 8, 9) defining a space (10, 11, 12) adapted to receive exercise equipment. A plurality of mounting means (46) locatable on said frames to connect said modules together. A plurality of indicators (30) operatively associated with said modules and adapted in use to direct a user and/or trainer to the equipment to use for a particular exercise routine.

5 Claims, 13 Drawing Sheets

(51) Int. Cl.

| | |
|---|---|
| ***A63B 17/04*** | (2006.01) |
| ***A63B 71/02*** | (2006.01) |
| ***A63B 17/00*** | (2006.01) |
| ***A63B 5/20*** | (2006.01) |
| ***A63B 9/00*** | (2006.01) |
| ***A63B 21/072*** | (2006.01) |
| ***A63B 23/12*** | (2006.01) |
| ***A63B 4/00*** | (2006.01) |
| ***A63B 21/055*** | (2006.01) |
| ***A63B 23/04*** | (2006.01) |

(52) U.S. Cl.
CPC ..... *A63B 9/00* (2013.01); *A63B 17/04* (2013.01); *A63B 21/0552* (2013.01); *A63B 21/072* (2013.01); *A63B 23/0458* (2013.01); *A63B 23/1218* (2013.01); *A63B 23/1227* (2013.01); *A63B 71/0619* (2013.01); *A63B 23/1236* (2013.01); *A63B 2071/025* (2013.01); *A63B 2071/0625* (2013.01); *A63B 2071/0694* (2013.01); *A63B 2209/10* (2013.01); *A63B 2225/10* (2013.01); *A63B 2225/682* (2013.01); *A63B 2225/685* (2013.01)

(58) Field of Classification Search
CPC ..... A63B 23/1227; A63B 21/072; A63B 9/00; A63B 6/00; A63B 5/20; A63B 71/0619; A63B 17/04; A63B 2225/10; A63B 2209/10; A63B 2071/0694; A63B 2071/0625; A63B 2071/025; A63B 2225/685; A63B 2225/682; A63B 23/1236
See application file for complete search history.

(56) References Cited

U.S. PATENT DOCUMENTS

| | | | | | |
|---|---|---|---|---|---|
| 5,667,267 | A * | 9/1997 | Talucci | B60P 3/14 | 296/26.15 |
| 7,772,986 | B2 * | 8/2010 | Olson | B65D 55/028 | 340/692 |
| 7,930,857 | B2 * | 4/2011 | Pope | E04B 1/3431 | 52/67 |
| 8,109,862 | B2 * | 2/2012 | Cooper | A63B 17/00 | 482/83 |
| 8,474,190 | B1 * | 7/2013 | Sanderson | E04H 3/12 | 52/8 |
| 2003/0052040 | A1 * | 3/2003 | Brener | B65D 5/52 | 206/736 |
| 2006/0223674 | A1 * | 10/2006 | Korkie | A63B 24/00 | 482/8 |
| 2008/0134589 | A1 * | 6/2008 | Abrams | E04B 1/34384 | 52/79.1 |
| 2008/0179214 | A1 * | 7/2008 | Hall | A63B 71/0036 | 206/579 |
| 2009/0195008 | A1 * | 8/2009 | Braswell | B60P 3/0252 | 296/26.15 |
| 2009/0282749 | A1 * | 11/2009 | Warminsky | E04H 9/10 | 52/79.1 |
| 2010/0042555 | A1 * | 2/2010 | Ranen | G07F 17/00 | 705/418 |
| 2011/0005144 | A1 * | 1/2011 | McDougall | E02D 27/50 | 52/79.1 |
| 2012/0144762 | A1 * | 6/2012 | Eatock | G09B 19/00 | 52/79.5 |
| 2013/0053220 | A1 * | 2/2013 | Monaco | A63B 17/04 | 482/39 |
| 2014/0067097 | A1 * | 3/2014 | Harris | G16H 20/30 | 700/91 |
| 2014/0274563 | A1 * | 9/2014 | Sheta | A63B 69/125 | 482/2 |
| 2015/0059257 | A1 * | 3/2015 | Beaver | E04H 3/10 | 52/27 |
| 2016/0059104 | A1 * | 3/2016 | Monaco | E04H 3/14 | 280/30 |

OTHER PUBLICATIONS

"NU Era Firness Modular Pull up Rigs", online, Jun. 1, 2014 (retrieved from the Internet on Dec. 19, 2016; http://web.archive.org/web/2014060105214/http://www.nuerafitness.com/pull-up-rigs/.

* cited by examiner

EXERCISE DEVICE AND METHOD OF EXERCISING USING SAID DEVICE

CROSS REFERENCE TO RELATED APPLICATIONS

The presently disclosed subject matter is related and claims priority to International PCT Application No. PCT/AU2015/000358, entitled "AN EXERCISE DEVICE AND METHOD OF EXERCISING USING SAID DEVICE," filed on Jun. 19, 2015 and which claims priority to Australian Application No. 2014100698, filed on Jun. 20, 2014; the entire disclosures of which are incorporated herein by reference.

FIELD

The present invention relates to an exercise device and in particular to methods of exercising using said device.

BACKGROUND

People exercise for various reasons, such as, enjoyment of exercising, to maintain a fitness or strength level or to lose weight. In many cases, people exercise at a fitness centre or go for a swim or a run. In all these cases, people tend to be exercising on their own and with little structure or guidance. It has been found that when exercising on your own or without structure, a person is less likely to be motivated to exercise correctly, regularly or at a sufficient level to achieve goals, such as, increased fitness, strength or loss of weight. There is therefore a need to encourage people to exercise together in a structured environment to provide motivation for people to regularly exercise. In an effort to overcome these issues there has been an increase in the number of personal trainers working out in parks and other public areas. It is however difficult for a personal trainer to provide or even carry, a sufficient variation in equipment to properly train an individual or group of individuals. Accordingly, there is also a need to provide a mobile exercise device that can be located anywhere at any time and provide a wide range of exercise equipment that can be used by one or more people. There is also a need to provide a device that permits exercising participants of various fitness levels to exercise together at the same time using the same mobile device and provide a fitness instructor or the like with a compact multi-use mobile fitness station providing a variety of exercise equipment to provide a variety of fitness programs and visual competition.

OBJECT OF THE INVENTION

It is an object of the present invention to substantially overcome or at least ameliorate one or more of the disadvantages of the prior art, or to at least provide a useful alternative.

SUMMARY OF INVENTION

There is disclosed herein a mobile exercise device having:

at least one exercise equipment module;

each said module including a frame defining a space adapted to receive exercise equipment;

a plurality of mounting means locatable on said frames to permit said at least one module to connect to a support surface or other said modules;

a plurality of indicators operatively associated with said at least one module and adapted in use to direct a user and/or trainer to the equipment to use for a particular exercise routine; and wherein at least one said module can be utilised as an exercise platform, so that a series of exercises can be performed utilizing said platform in limited space locations.

Preferably, said mobile exercise device including a plurality of exercise equipment modules, said modules adapted to connect together.

Preferably, said device includes at least three modules.

Preferably, said platform is a bench.

Preferably, each said indicator includes a unique identifier.

Preferably, said identifier is a number, letter or combination thereof.

Preferably, at least one module includes at least one wheel to assist with the mobility of said device.

Preferably, said device includes a plurality of connectors adapted to hold exercise equipment.

Preferably, said device includes an exercise mat.

Preferably, said device includes a pull-up bar.

Preferably, said device includes handles.

Preferably, said device includes a stepping platform.

Preferably, said device includes exercise straps.

A method of conducting an exercise session at a location including:

locating said device in a location where the exercise session is to take place;

removing an exercise equipment from said device by locating an indicator assigned to said equipment;

setting up said selected equipment;

performing an exercise routine;

returning said equipment to said device in said specified location by way of said indicator; and removing said device from said location.

DESCRIPTION OF EMBODIMENTS

Figure 1:
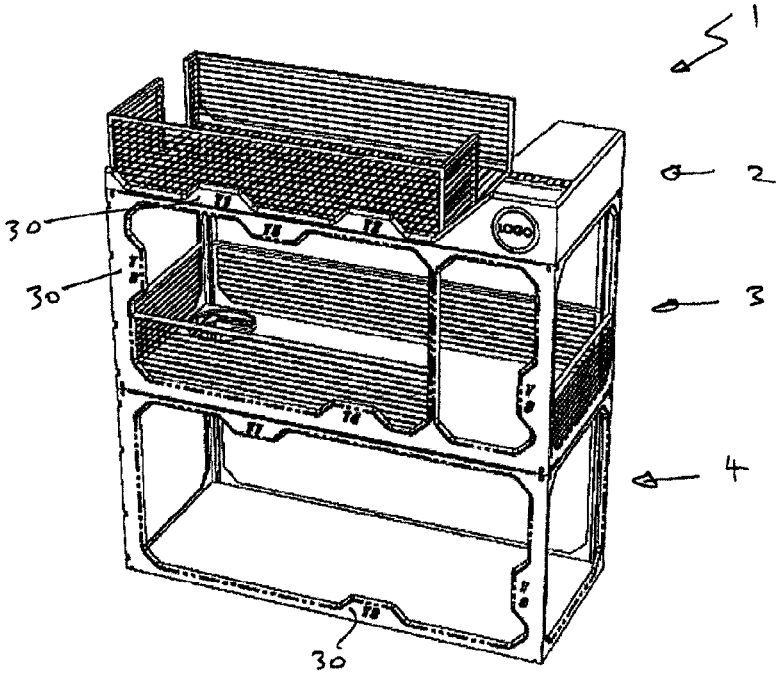
FIG. 1 is a perspective view of an exercise device of the present invention in an assembled state without exercise equipment shown.

Where reference is made in any one or more of the accompanying drawings to steps and/or features, which have the same reference numerals, those steps and/or features have for the purposes of this description the same function (s) or operation(s), unless mentioned to the contrary.

The exercise equipment (not all shown) used with the device 1 can be any type of exercise equipment, such as, dumbbells 100, medicine balls 101, skipping ropes, weights, obstacles 107, power bands, agility ladders 102, straps 103, nets, spikes, grids, beams 104, pull up bars 105, rowers 106, mats 108, or the like.

Figure 2:
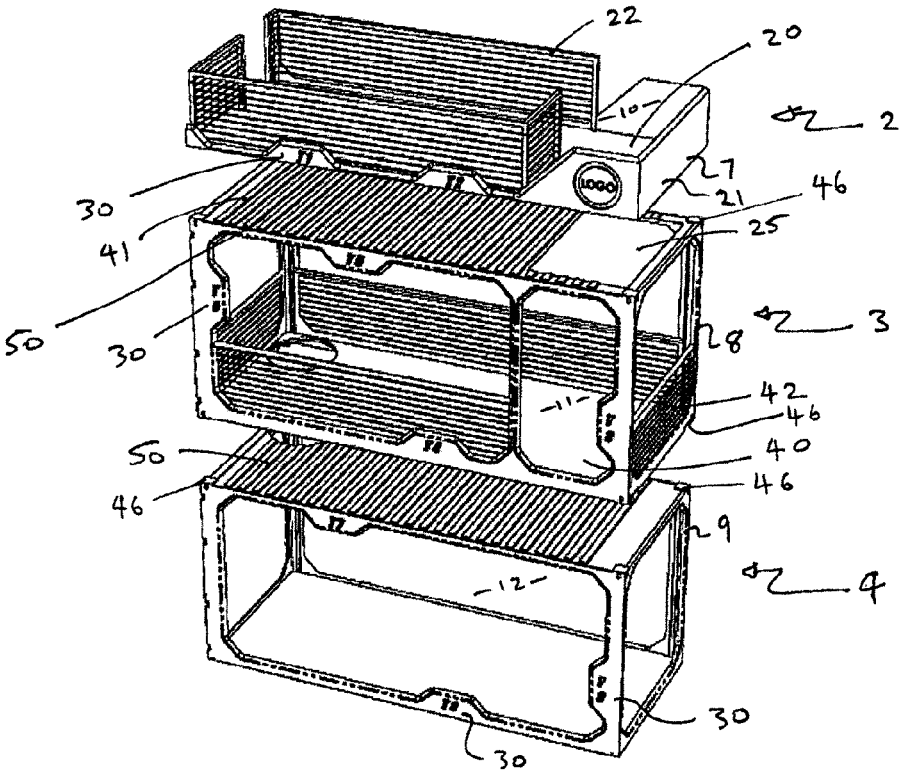
FIG. 2 is an expanded view of the modules of FIG. 1.
Figure 3:
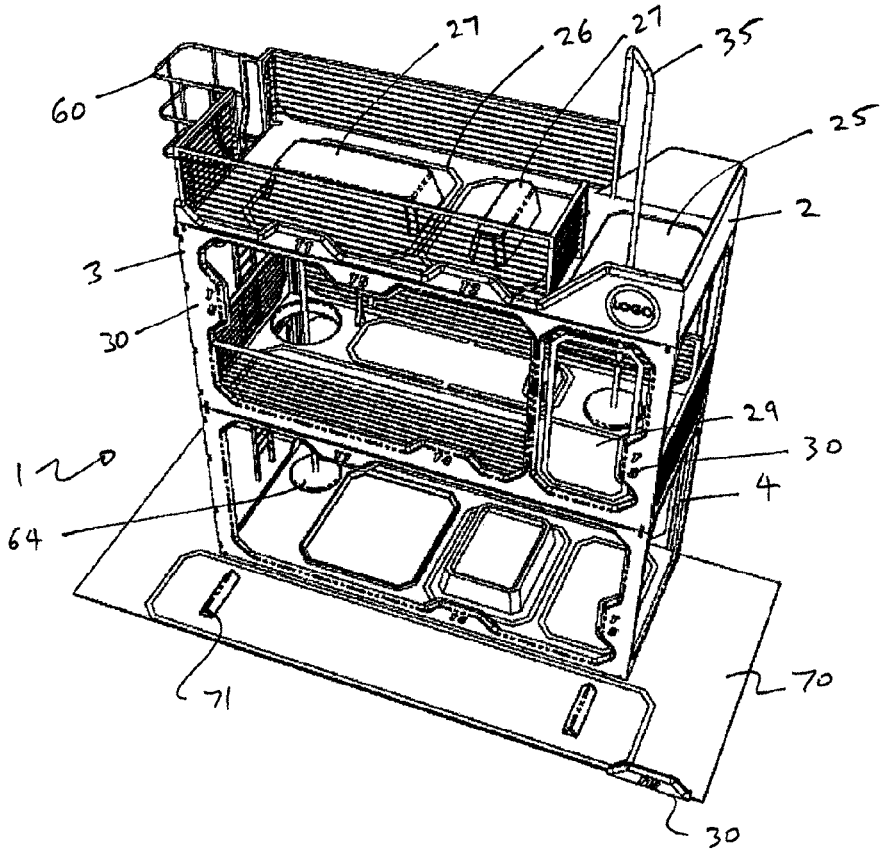
FIG. 3 is a perspective view of an embodiment of the exercise device of the present invention with some exercise equipment shown.
Figure 4:
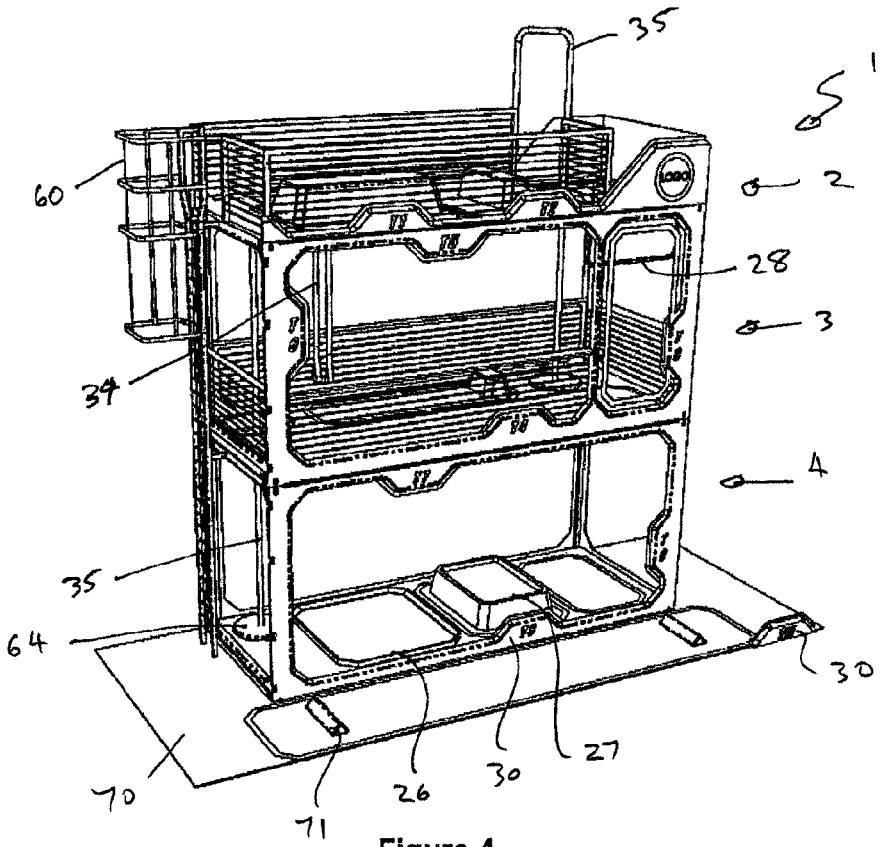
FIG. 4 is a further perspective view of FIG. 3.
Figure 5:
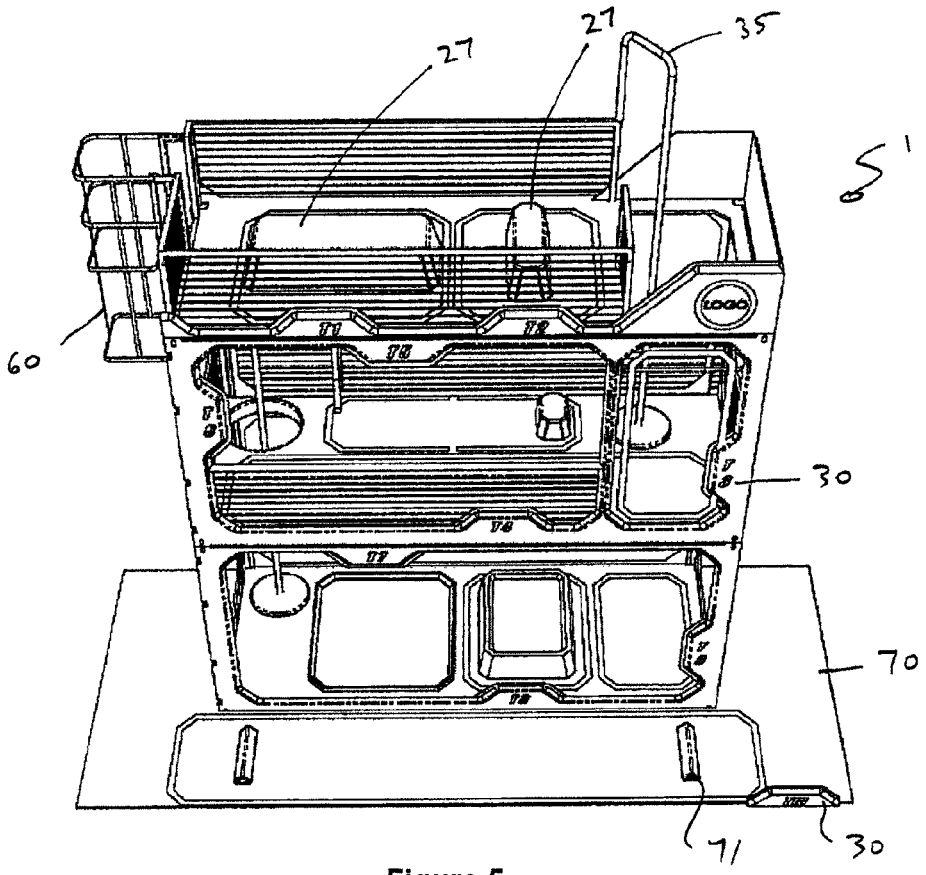
FIG. 5 is a further perspective view of FIG. 3.
Figure 6A:
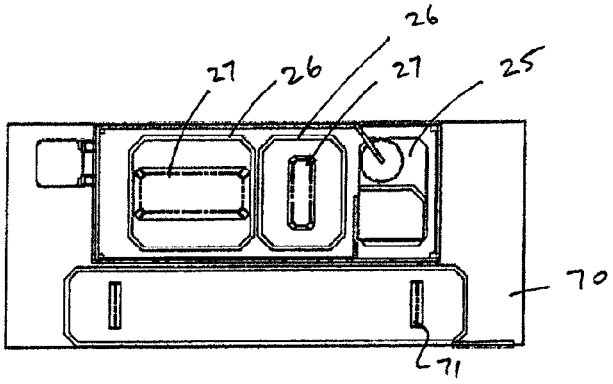
FIGS. 6*a*, 6*b*, 6*c*, 6*d* are top view, front view, left and right side views of the embodiment of FIG. 3.
Figure 6C:
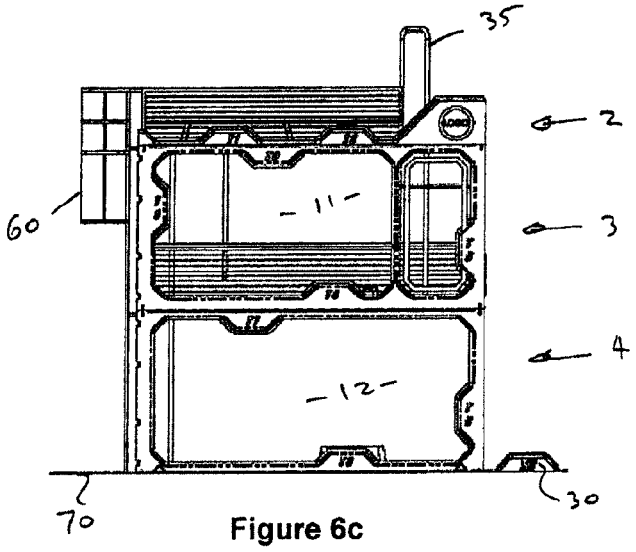
Figure 6B:
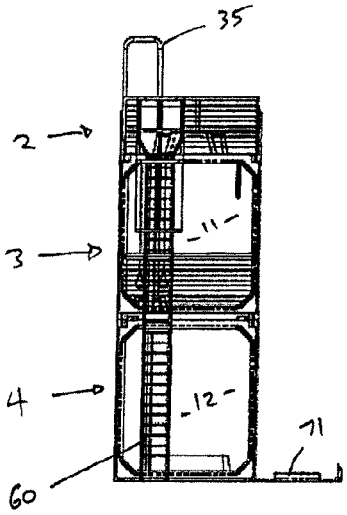
Figure 6D:
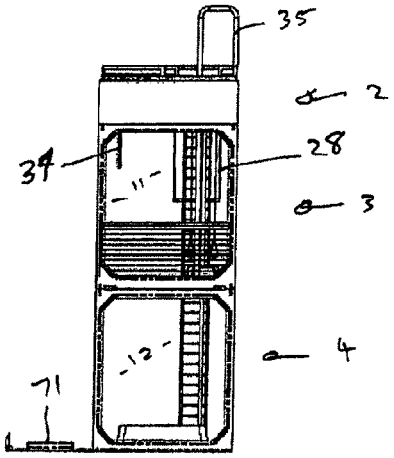

There is disclosed herein an exercise device 1 having one or more exercise equipment modules 2, 3, 4. Each module 2, 3, 4 includes a frame 7, 8, 9 defining a space 10, 11, 12 adapted to receive exercise equipment. In the figures three modules are shown. It should however be noted that any number of modules could be included in the device 1. In the FIGS. 1 to 6*d*, module 2 includes a base 20 and walls extending upwardly therefrom. In this embodiment, it can be seen that there are fixed closed walls 21 and open caged walls 22. The caged walls 22 could for example include a frame and steel wires as shown and may or may not connect with each other. In this embodiment, the module 2 is open at the top. The module 2 includes a number of indicators 30 to indicate where exercise equipment should be stored or taken from by an exercise participant or exercise instructor. The module 2 also includes connectors (not shown) to connect module 2 with other modules, such as module 3. The base 20 of the module 2 includes a rubber floor mat or the like and also floor markings 26, decals, cutouts or the like for receipt of particular exercise equipment or to facilitate an exercise program. The base 20 also includes an opening 25 to allow larger items to be stored between modules 2, 3. The module 2 also includes a number of customized platforms, benches, balance beams or boards, or the like 27 which can be fixed to the base 20 or be removable for use also as separate exercise equipment. The second module 3 shown in the embodiment includes a base 40, a roof 41 and walls 42 extending either partially or fully therebetween. As shown in the FIGS. 1 to 6*d*, the roof and base 40, 41 could include openings 25 so that equipment can extend between modules 2, 3. The walls 42 could also be solid or steel wires as mentioned above. The module 3 could be for example 20 feet long however the modules could be any size. The base 40 also includes a sprint lane rubber matting 29 in a contrasting color, design or the like. The module 3 also includes indicators 30 to provide location and directions for storing and retrieving equipment or providing directions to a user or instructor. The module 3 also includes additional members such as ankle strapping or hand straps 34, timber platforms or benches 27, pull-up bars 28, fireman's poles 35 or the like. One or more of the walls 42 also includes glass or Perspex panels or the like. The module 3 would also include connectors 46 to be able to connect between modules 2, 3, 4. In this embodiment, they are shown as male and female connectors however other typical connectors could be utilized. The third module 4 shown is substantially the same as the second module 3 however each module 2, 3, 4 could be configured as required. It should be noted that any number of combinations of exercise equipment could be included and any type of material could be used for the module construction. However, the modules 2, 3, 4 should be sufficiently rigid and strong so that they can be used to exercise on such as with an exercise platform. The exercise platform can be sufficiently large that users can climb on and through the platform or small enough to be used as a bench or the like. That is, the top surfaces 50 of the modules 3, 4 should include strengthening ridges or the like as shown. They can also include a non-slip surface. The platform allows an exercise participant to utilize a module in one embodiment like a bench or stepper or the like. The modules 2, 3, 4 should also have sufficient space for signage 200 or the like. The modules 2, 3, 4 could also include a stock caged ladder 60 or the like. The fire pole 35 could for example be 60 mm diameter steel fixed to the upper and lower modules 2, 4 and could include a foam landing 64 or the like.

The device 1 can include wheels (not shown) to assist with the mobility of the device 1 to a particular location where exercise is to be conducted. The device 2 can include feet (not shown) to raise the device 1 above a ground surface and also include compartments to receive exercise equipment, water bottles, locators or any other such items. The device could include a handle (not shown) to better move the device 1 when on wheels. In an alternate embodiment, the wheels and axle of the device 1 are adjustably configurable to form bar bells or the like usable by the exercise user.

In a further embodiment, the device 1 can include power means in the form of solar panels, batteries or electrical mains power access (not shown). The device 1 however does not necessarily need power. The device 1 could further include a flag or the like and means to provide attachment for an audio device for the users of the device (not shown). The audio means can include speakers or the like or access to electronic mobile devices, such as, mobile phones or iPods or similar such devices.

The device 1 could also include an exercise mat 70 which includes indicators 30 and handles 71. The handles 71 could be attached by hook and loop fasteners or the like.

Figure 7:
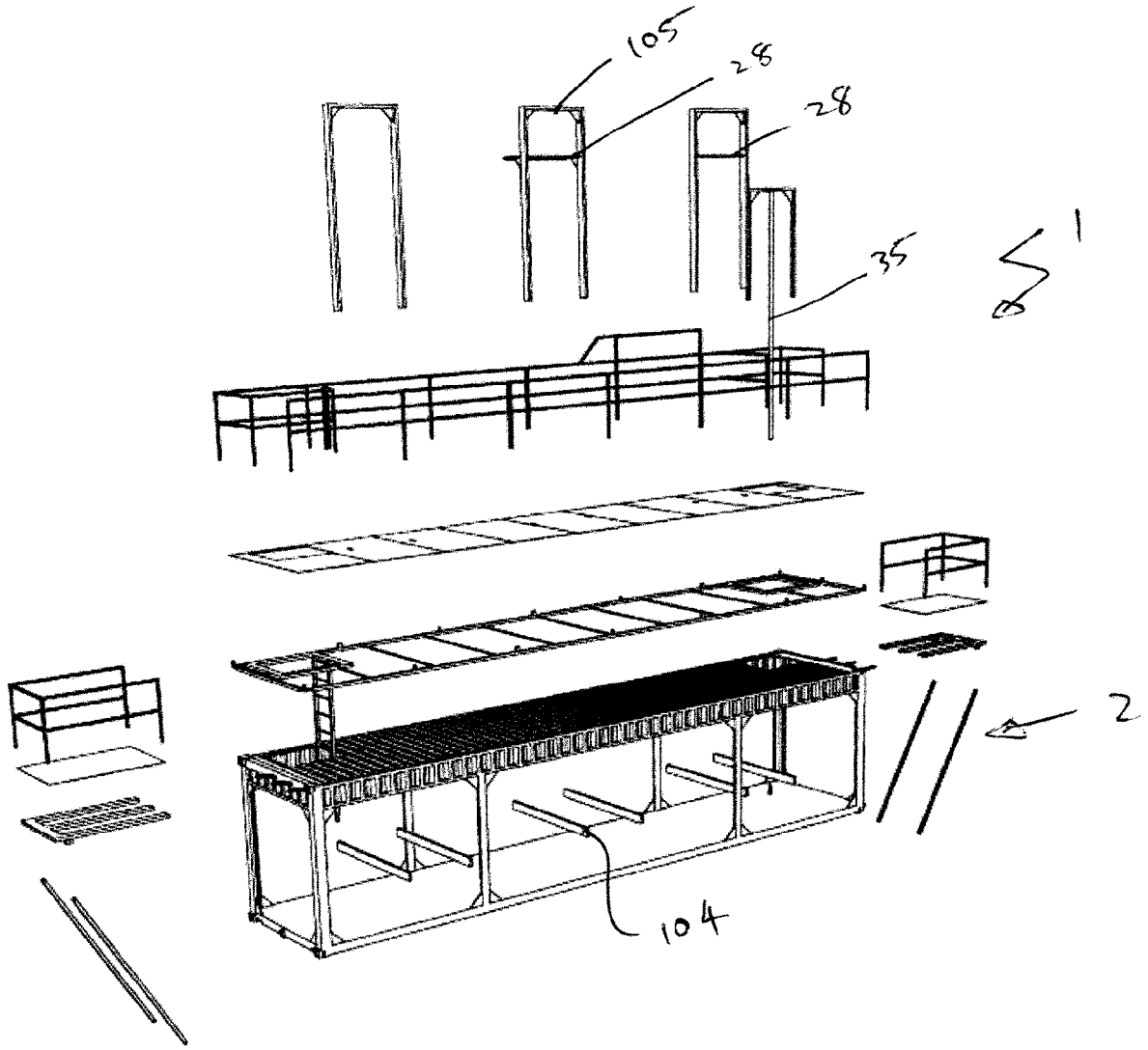
FIG. 7 is a parts exploded view of an alternate embodiment of an exercise device of the present invention.
Figure 8A:
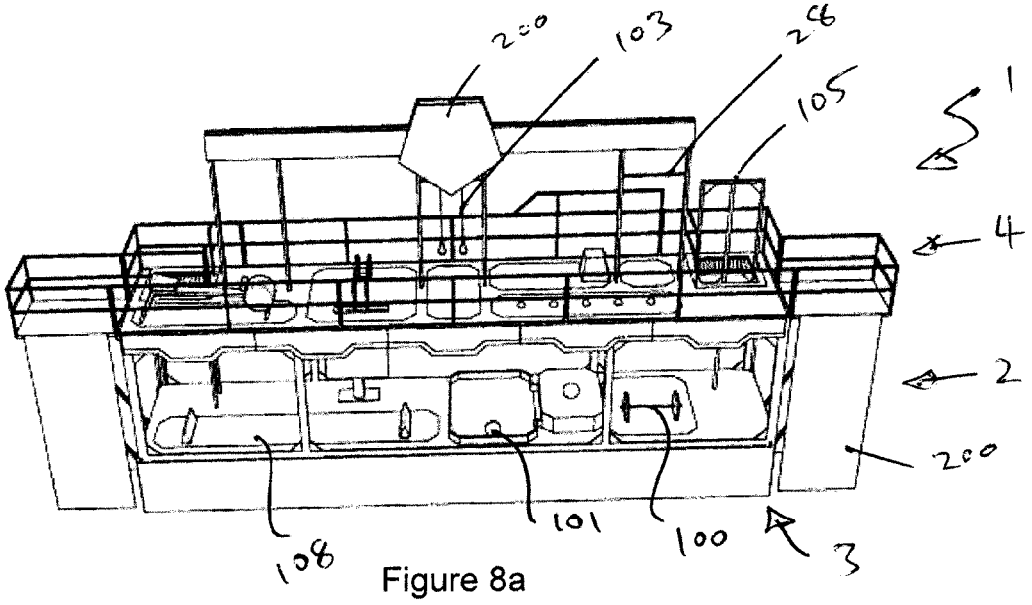
FIGS. 8*a*, 8*b*, 8*c*, 8*d*, 8*e*, 8*f* are perspective, top, front, sides and bottom views of a further embodiment of an exercise device of the present invention.
Figure 8B:
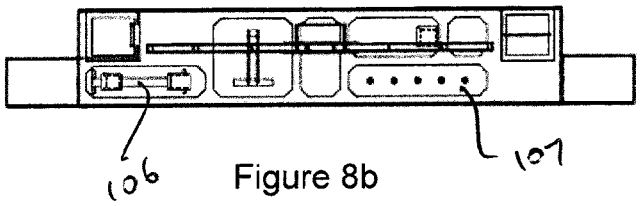
Figures 8C, 8D, 8E:
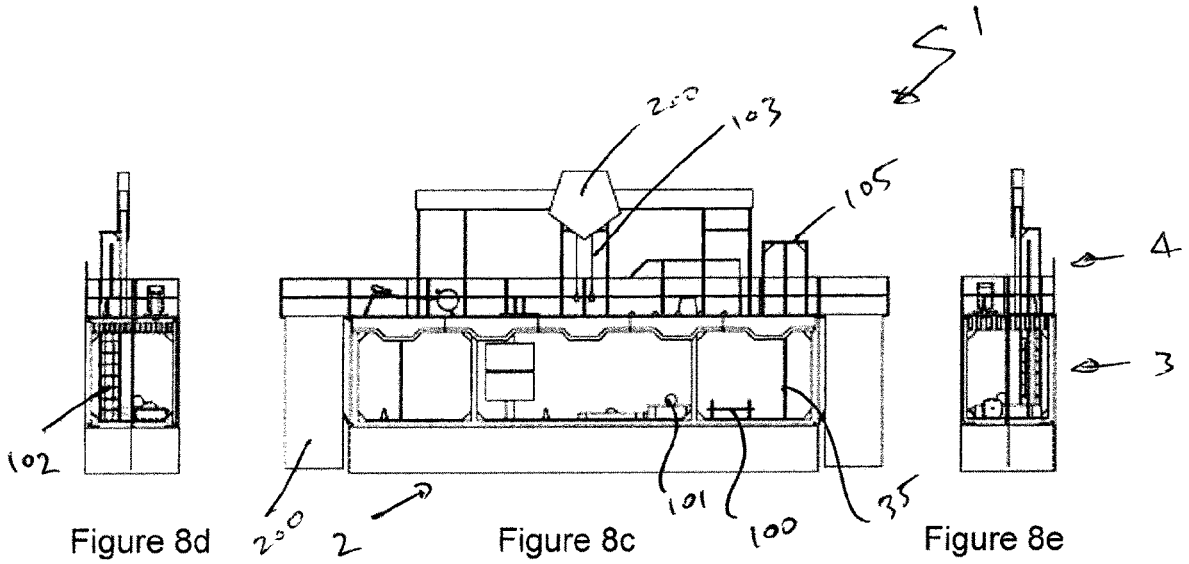
Figure 8F:
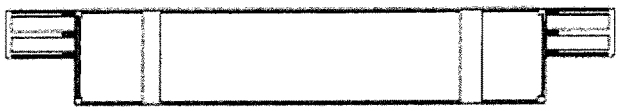
Figure 9A:
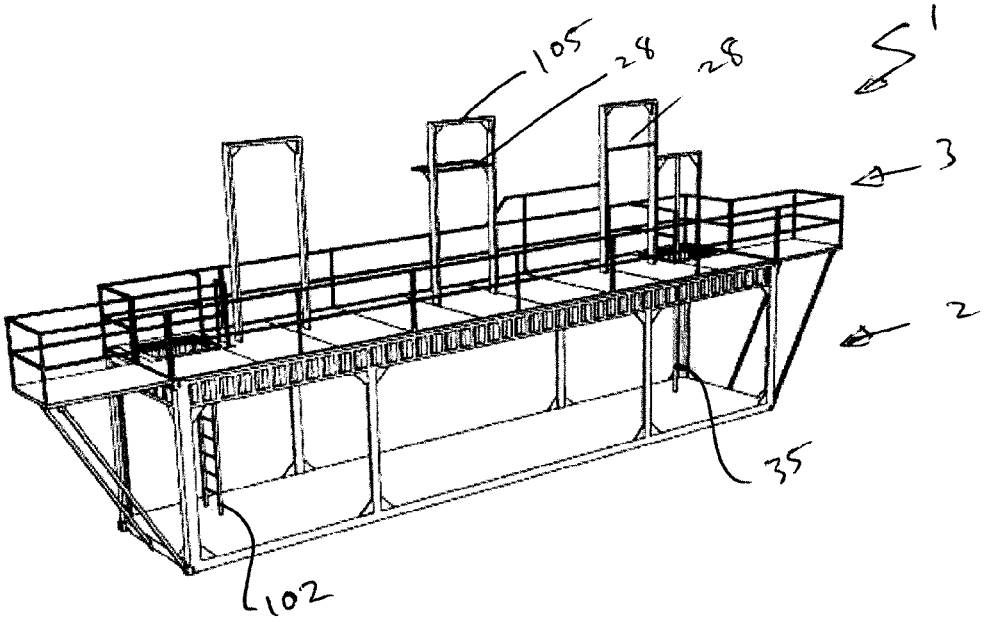
FIGS. 9*a*, 9*b*, 9*c*, 9*d*, 9*e*, 9*f* are perspective, top, front, sides and bottom views of a further embodiment of the present invention.
Figure 9B:
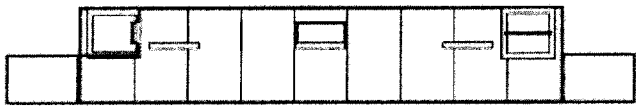
Figure 9D:
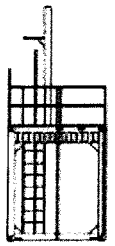
Figure 9C:
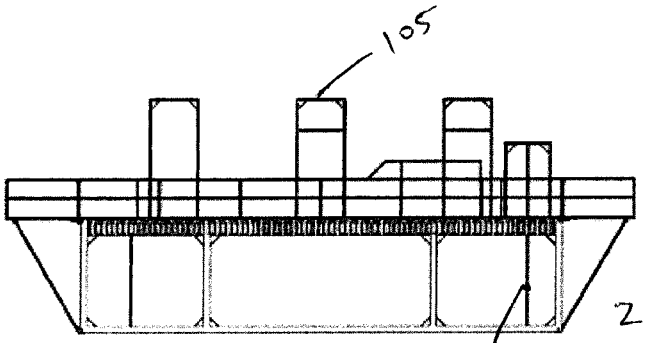
Figure 9E:
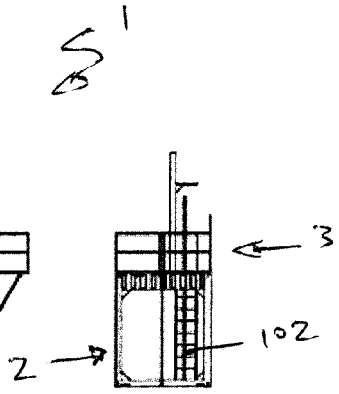
Figure 9F:
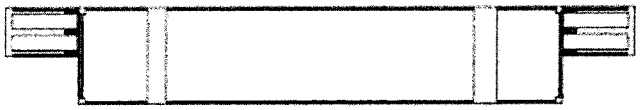
Figure 10A:
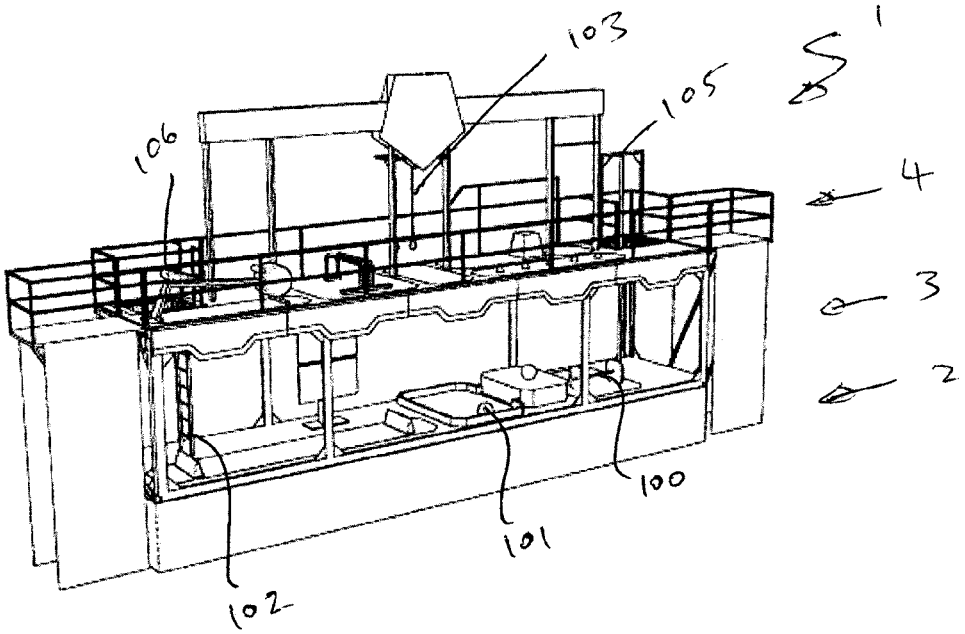
FIGS. 10*a*, 10*b* are a further embodiment of the present invention.
Figure 10B:
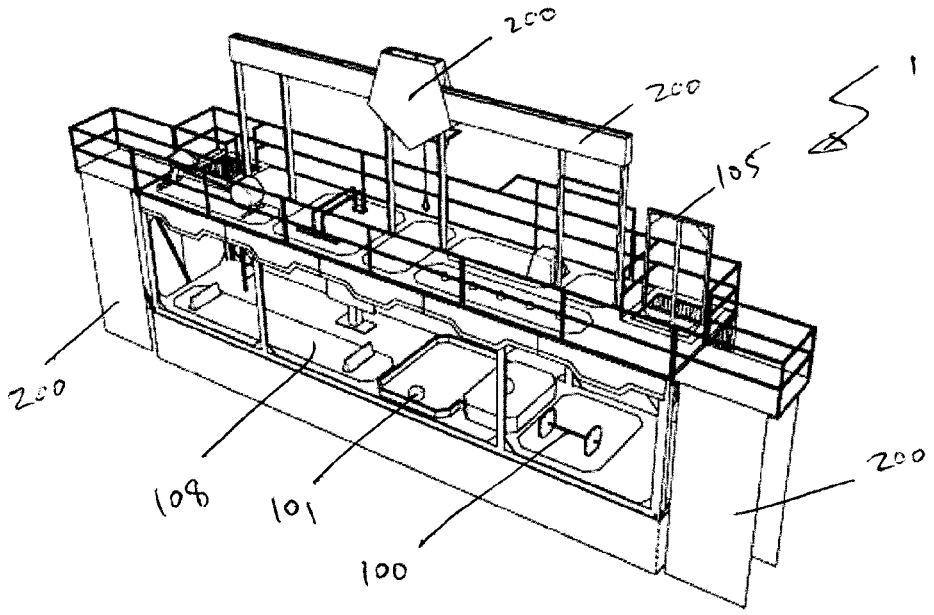

In further embodiments showing in FIGS. 7, 8*a* to 8*f*, 9*a* to 9*f* and 10*a* and 10*b* further embodiments of the present invention are shown and in particular how a platform style device 1 can be used effectively as a sporting and fitness apparatus. In these embodiments, the modules 2, 3, 4 are large in size. Advertising 200 can also be utilised to provide an enhanced user experience to make the device 1 used for competitions in front of crowds or the like. Circuit type programs can be run along and throughout the exercise modules 2, 3, 4 all in a limited and compact space. Such modules can be placed in any location and transported easily on the back of a truck or the like. They could include wheels and be towed. The integration of so many combinations of possible exercise routines and equipment in a small surface area provides significant advantages over existing systems and provides significant advertising abilities, in particular when running competitions, demonstrations or the like in various outdoor locations.

Although the invention has been described with reference to specific examples, it will be appreciated by those skilled in the art that the invention may be embodied in many other forms.

The invention claimed is:

1. A mobile exercise device comprising:

a plurality of exercise equipment modules configured to be arranged in a stack for use in limited space locations;

each of said exercise equipment modules including a frame defining a space adapted to receive separate/removable exercise equipment, wherein at least one of the exercise equipment modules has at least one open caged wall;

separate removable exercise equipment located in said space to use for a particular exercise routine when the exercise equipment modules are deployed and in use for exercise;

a plurality of connectors locatable on said frames to permit at least one of said exercise equipment modules to connect to a support surface or other said exercise equipment modules;

a plurality of indicator tabs forming a part of each frame, each of said plurality of indicator tabs having an indicator associated with the corresponding exercise equipment module and adapted in use to direct an exercise participant and/or exercise instructor to said separate/removable exercise equipment located in said space of the corresponding exercise equipment module to use for said particular exercise routine;

wherein, in use, said exercise equipment modules are utilized as an exercise platform, so that a series of exercises can be performed utilizing said exercise platform in limited space locations, and wherein the mobile exercise device is an outdoor mobile exercise device.

2. The mobile exercise device according to claim 1, wherein at least one of the plurality of exercise equipment modules includes a bench.

3. The mobile exercise device according to claim 1, wherein each of said plurality of indicators includes a unique identifier.

4. The mobile exercise device according to claim 1, wherein the plurality of indicators indicate where in the space separate/removable exercise equipment should be stored or taken from by the exercise participant or exercise instructor.

5. The mobile exercise device according to claim 1, wherein the space includes at least one of a floor mat, a floor marking, a decal, and a cutout to receive the separate/removable exercise equipment and/or to facilitate the particular exercise routine.

* * * * *